US006547625B2

(12) United States Patent
Whitehead

(10) Patent No.: US 6,547,625 B2
(45) Date of Patent: Apr. 15, 2003

(54) TOY WITH MOVEMENT MEANS

(75) Inventor: Brian Whitehead, London (GB)

(73) Assignee: Origin Products Ltd., London (GB)

( * ) Notice: Subject to any disclaimer, the term of this patent is extended or adjusted under 35 U.S.C. 154(b) by 66 days.

(21) Appl. No.: 09/785,379

(22) Filed: Feb. 16, 2001

(65) Prior Publication Data

US 2002/0115376 A1 Aug. 22, 2002

(51) Int. Cl.[7] ..... A63H 33/26
(52) U.S. Cl. ..... 446/132; 446/133; 446/359
(58) Field of Search ..... 446/82, 83, 330, 446/332, 359, 365, 376, 129, 132, 133, 134, 135

(56) References Cited

U.S. PATENT DOCUMENTS

| | | | | |
|---|---|---|---|---|
| 1,323,232 A | | 11/1919 | Page | |
| 2,036,076 A | | 3/1936 | Philippi | 46/45 |
| 2,767,517 A | | 10/1956 | Hooper | 46/241 |
| 3,377,067 A | | 4/1968 | Proietti | 273/86 |
| 3,426,476 A | | 2/1969 | Ayala | 46/164 |
| 3,785,648 A | | 1/1974 | Kobayashi | 273/85 |
| 3,823,941 A | | 7/1974 | Ochi et al. | 273/86 |
| 3,946,520 A | | 3/1976 | Goldfarb et al. | 46/240 |
| 4,878,878 A | * | 11/1989 | Bittner | 446/134 |
| 6,193,581 B1 | * | 2/2001 | Wiggs et al. | 446/134 |

FOREIGN PATENT DOCUMENTS

| | | | |
|---|---|---|---|
| DE | 873003 | 4/1953 | 42/609 |
| FR | 1097437 | 7/1955 | 20/1 |
| GB | 2328622 | 3/1999 | 33/26 |

* cited by examiner

*Primary Examiner*—Jacob K. Ackun
(74) *Attorney, Agent, or Firm*—Woodard, Emhardt, Naughton, Moriarty & McNett LLP

(57) ABSTRACT

The invention relates to the provision of a toy which comprises at least one article which is movable with respect to a play base and objects on the playbase. The article can have at least one part which is movable with respect to the remainder of the article and the movement is achieved via a magnetic arrangement which involves at least one magnet in the movable part of the article and at least one magnet in a movement means such that as the movement means and/or article move in sufficient proximity, the magnetic forces and field created cause movement of the said part of the article to provide an animated feature to the article.

55 Claims, 7 Drawing Sheets

TOY WITH MOVEMENT MEANS

Figure 1A:
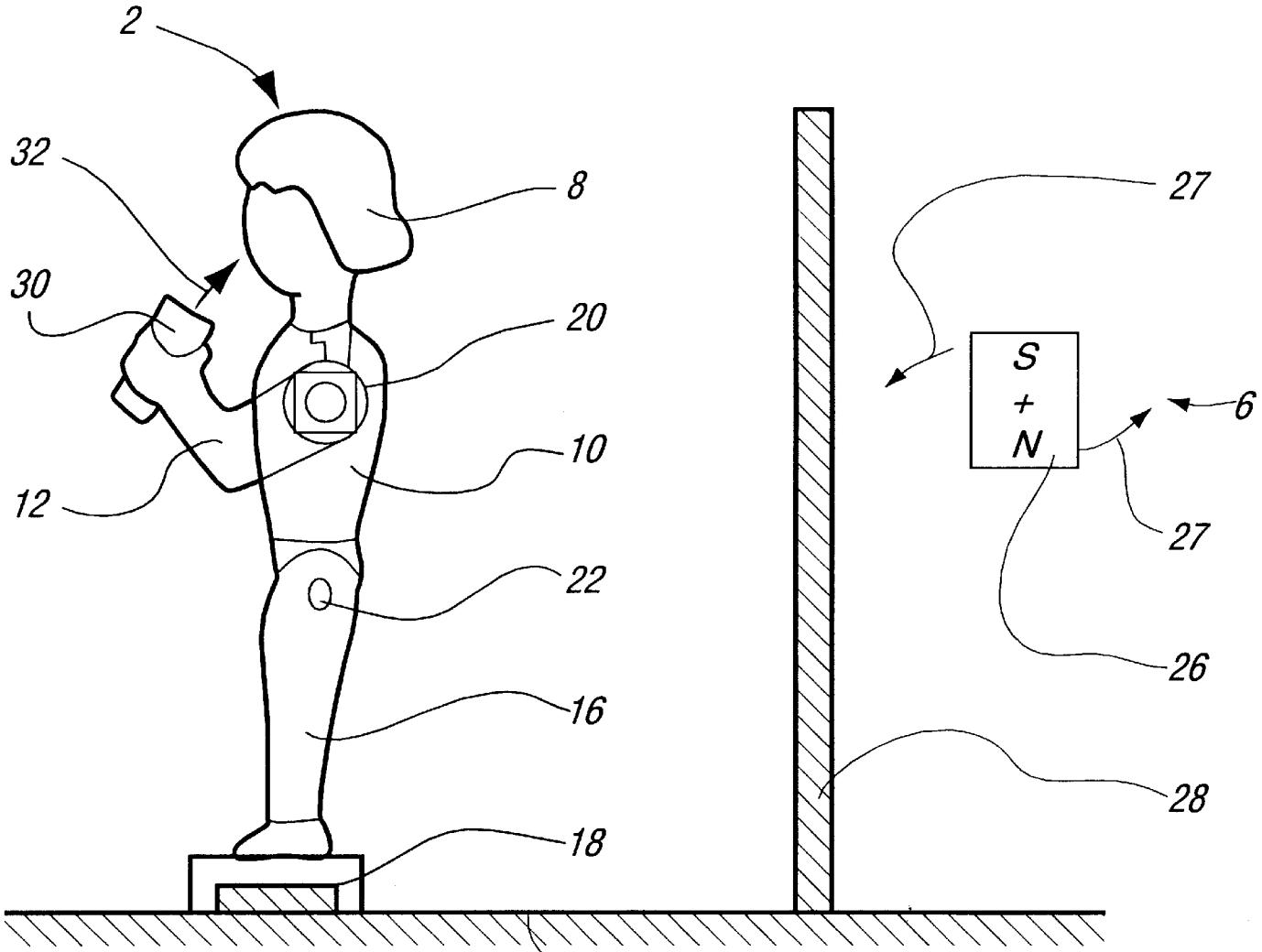

This invention relates to a toy which allows a part of an article such as, but not exclusively, a scaled down model of a person, an animal or the like, to be moved without any direct physical contact being applied thereto.

Conventionally it is known for toys to have parts which are movable and this allows the toys to move and perform actions which renders the toys more life like and thus more attractive to children. This attractiveness is further enhanced if the movement of the article arises without the child actually having to touch the movable parts of the article. The movement of the parts of the article can be operated by a mechanical mechanism or by a clockwork mechanism, which typically has to be wound up to initiate movement. Both of these mechanisms have the disadvantage that they comprise expensive components and they do not interact realistically with an environment in which they are placed and/or perform different actions in different environments. In addition, such mechanisms are unsuitable for using in small articles, thereby limiting the size of the articles that can be provided with moving parts. It is also known to use the attraction and/or repulsion of magnets to cause movement of articles or components but a typical problem is that such use and movement only results in a direct correlation between the extent and direction of movement of the first magnet being mirrored by the extent and direction of movement of the second magnet which can quickly become dull to children using the toy.

It is therefore an aim of the present invention to provide a toy which includes an article which has movable parts to allow the same to perform one or more actions at different points in an environment, under the influence of a control magnet and for said movement, if desired, to be proportional to the movement of the control magnet.

A further aim is to provide movement means for the toy which allows control of movement of parts of a toy from a position remote to the article and also to provide movement means with mechanical advantage thereby increasing the scope of movement of the article.

A yet further aim is to provide movement means for a toy including a small article, the article being too small to enable conventional movement mechanisms to be used.

According to a first aspect of the present invention there is provided a toy, said toy comprising at least one article with at least a first magnet, and movement means acting on at least a second magnet, said at least one article having one or more movable parts to provide movement of one or more parts of said article and wherein the movement means is positioned out of direct contact from the article and is arranged to impart movement of said one or more moveable parts thereby providing animation of the one or more parts of the article, as a result of movement of one of the first or second magnets with respect to the other of the first or second magnets.

The movement to be imparted on the article occurs when the said first and second magnets are within their respective magnetic fields.

Typically the article and movement means are integral components of the toy and are provided, in one embodiment, attached to a playbase or other components to form the toy.

In one embodiment the movement means imparts linear motion to the one or more movable joints. In this embodiment the movement means is actuated linearly with respect to the article to produce linear motion of the article. In a further embodiment the movement means can impart rotational motion to the one or more movable joints. In this embodiment the movement means can be actuated linearly and/or rotationally to result in linear and/or rotational motion of one or more parts of the article.

In one embodiment one of the at least two magnets can be moved about and/or along multiple axes simultaneously giving rise to a greater range of movement of the one or more movable joints and results in expressive and lifelike movement.

Preferably the at least first magnet of the article is located in the one or more movable joints with a magnetic polar axis perpendicular to the joint axis such that rotation of the magnet by the movement means results in rotation of a part of the article.

Typically movement of the at least second magnet in the movement means imparts motion of the at least first magnet in the article via the interaction of the magnetic fields of the at least two magnets, and thus results in movement of said one or more parts of the article.

Preferably the at least second magnet is arranged to impart motion to the at least first magnet by attraction and/or repulsion.

In one embodiment the polarity of the magnets are arranged such that the movement of one magnet achieves proportional movement in the other.

The at least first magnet can be positioned in a rotatable joint such that rotation of the same via the movement means results in rotation of a single part of the article. Alternatively, the at least first magnet can be positioned in a rotatable joint such that rotation of the same via the movement means results in rotation of more than one part of the article.

In one embodiment the article is in the form of a person and the rotatable joint is provided at the neck such that rotation of the first magnet in the rotatable joint, via movement of the movement means, results in rotation of the head.

In a further embodiment the article is in the form of a person and the rotatable joint is provided between the arms of the person such that rotation of the first magnet in the rotatable joint, via the movement means, results in rotation of the arms.

In one embodiment the at least one rotatable joint of the article is a ball joint and the first magnet is located in the same to allow a component to move in two axes simultaneously. In a further embodiment the rotatable joint is in the form of a cylindrical joint and the first magnet is located in the same. Typically the first magnet is mounted on a rotatable spindle such that its polar axis is at variance, such as 60 degrees, to the spindle axis so that when rotated in the vertical, the magnetic field and hence article, as well as rotating is caused to pitch up and down 30 degrees. This action imparts simultaneous movement in the two planes in the first magnet.

According to a second aspect of the present invention there is provided apparatus for a toy, said apparatus comprising a play base, at least one article which is movable about an upper surface of said play base using control means, and movement means, said at least one article having at least a first magnet located in one or more movable joints and said movement means having at least a second magnet and wherein said movement means is positioned remotely and out of contact with the article and is arranged to impart movement of said one or more movable joints thereby providing animation of the at least one article, by movement of the article and/or movement means with respect to each other.

Preferably the control means is provided with at least a third magnet and imparts movement of the article across the play base via interaction with a magnet provided in the base of the at least one article. Typically the at least third magnet of the control means contacts the underside of the upper surface of the play base and the magnet in the base of the article contacts the upper surface of the play base.

In one embodiment the movement means is provided adjacent the article. Typically the play base is provided with objects thereon in which the movement means can be located and/or hidden from view.

Typically the at least one article is moved across the surface of the play base using the control means, and the one or more movable joints on the article(s) are actuated to move when the at least first magnet of the article is a predetermined distance from the at least second magnet of the movement means, and the interaction of the movement means magnet and the at least first magnet of the article induces motion.

Typically the apparatus for the toy comprises a number of movement means located at different points on the play base.

Several articles can also be caused to be animated in accordance with the invention by a single common movement means.

In a yet further aspect of the invention there is provided a toy, said toy comprising at least one article with at least a first magnet positioned therein, and movement means with at least a second magnet positioned therein, said at least one article having one or more movable parts to provide movement of one or more parts of said article when the said first and second magnets magnetically influence each other and wherein actuation of the movement means in a first direction results in movement of the part or parts of the article in a direction other than the said first direction.

In one example, actuation in a linear direction causes rotational movement of the part of the article.

In this aspect there is a clear difference from prior art in that there is no direct relationship in terms of direction of movement, between the direction of movement of the actuation for the movement means and the direction of movement created on the part or parts of the article. This therefore adds to the unexpected and surprising nature of the toy to a child.

Figure 1B:
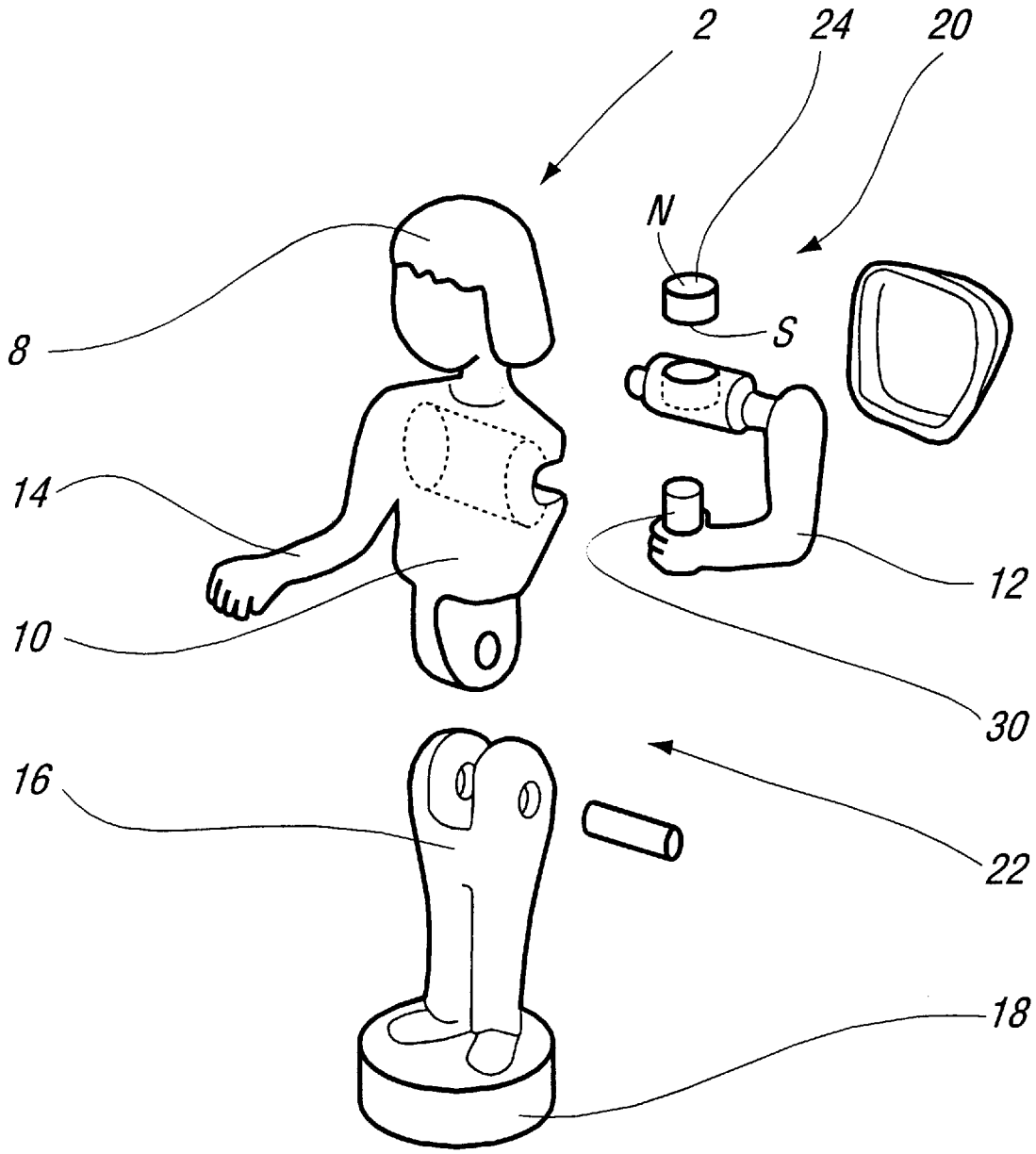

Embodiments of the invention will now be described with reference to the accompanying Figures wherein:

FIG. 1*a* illustrates an article on a play base;

FIG. 1*b* is an exploded view of the article on the play base in FIG. 1*a;*

Figure 2A:
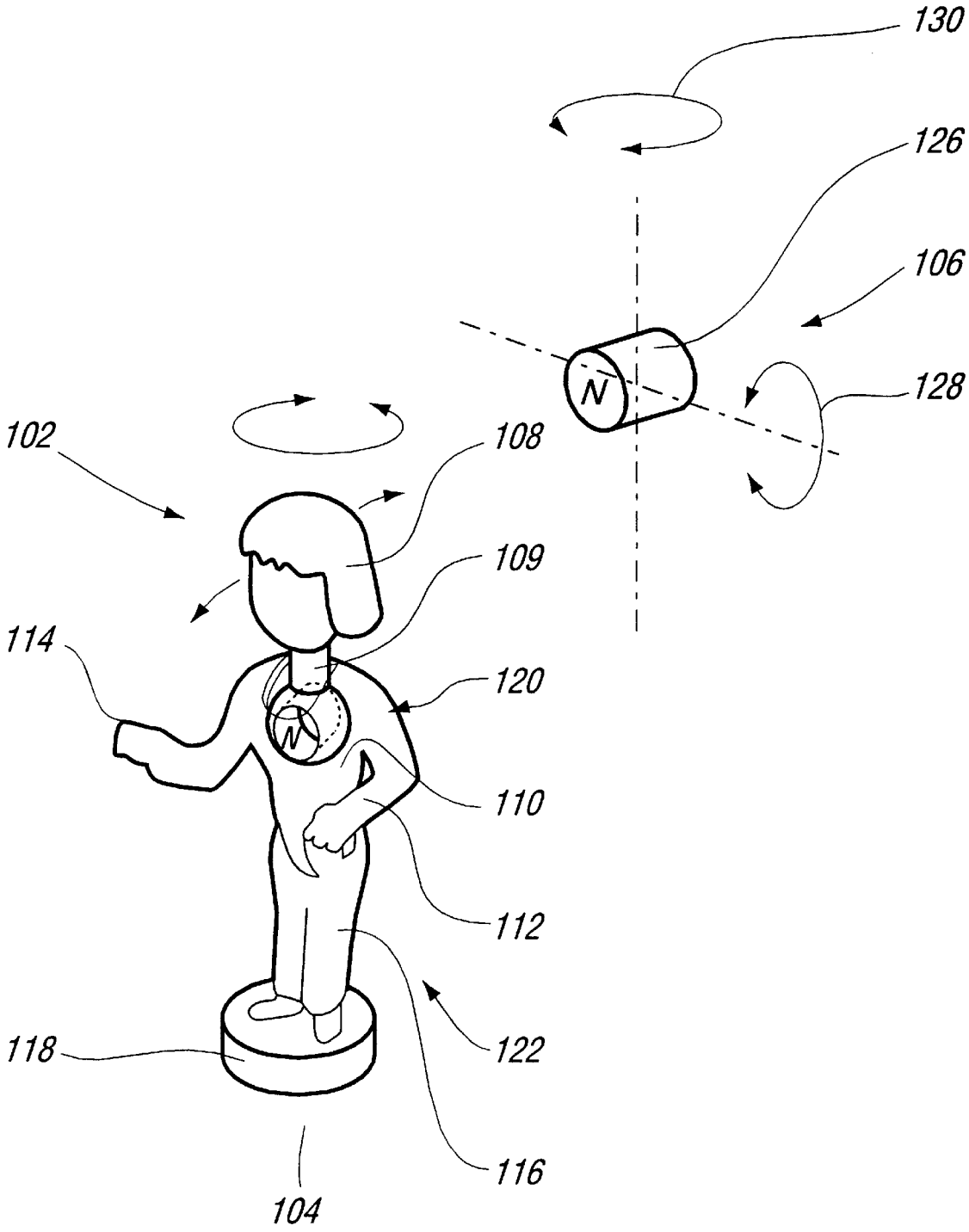
Figure 2B:
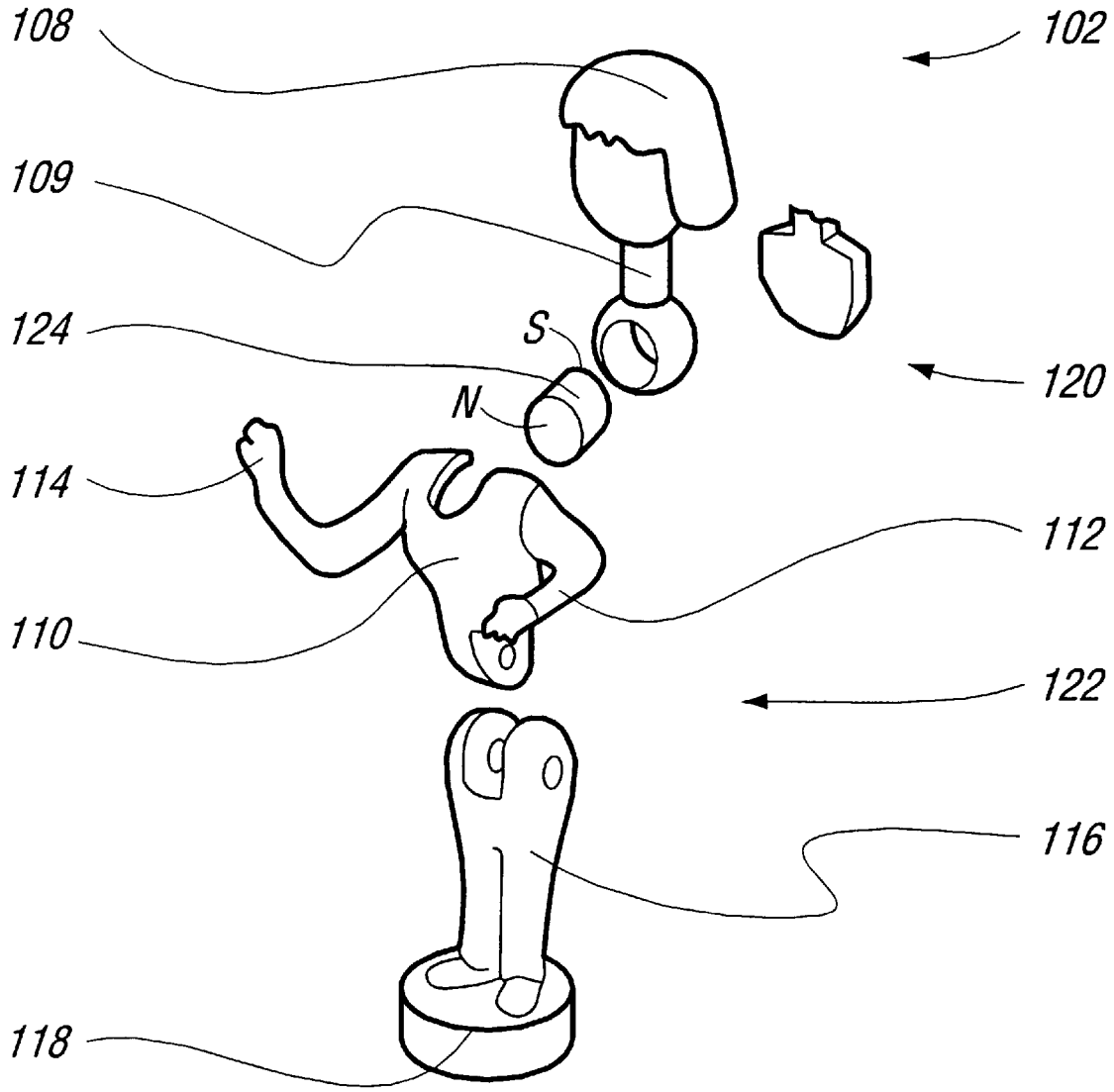
Figure 3:
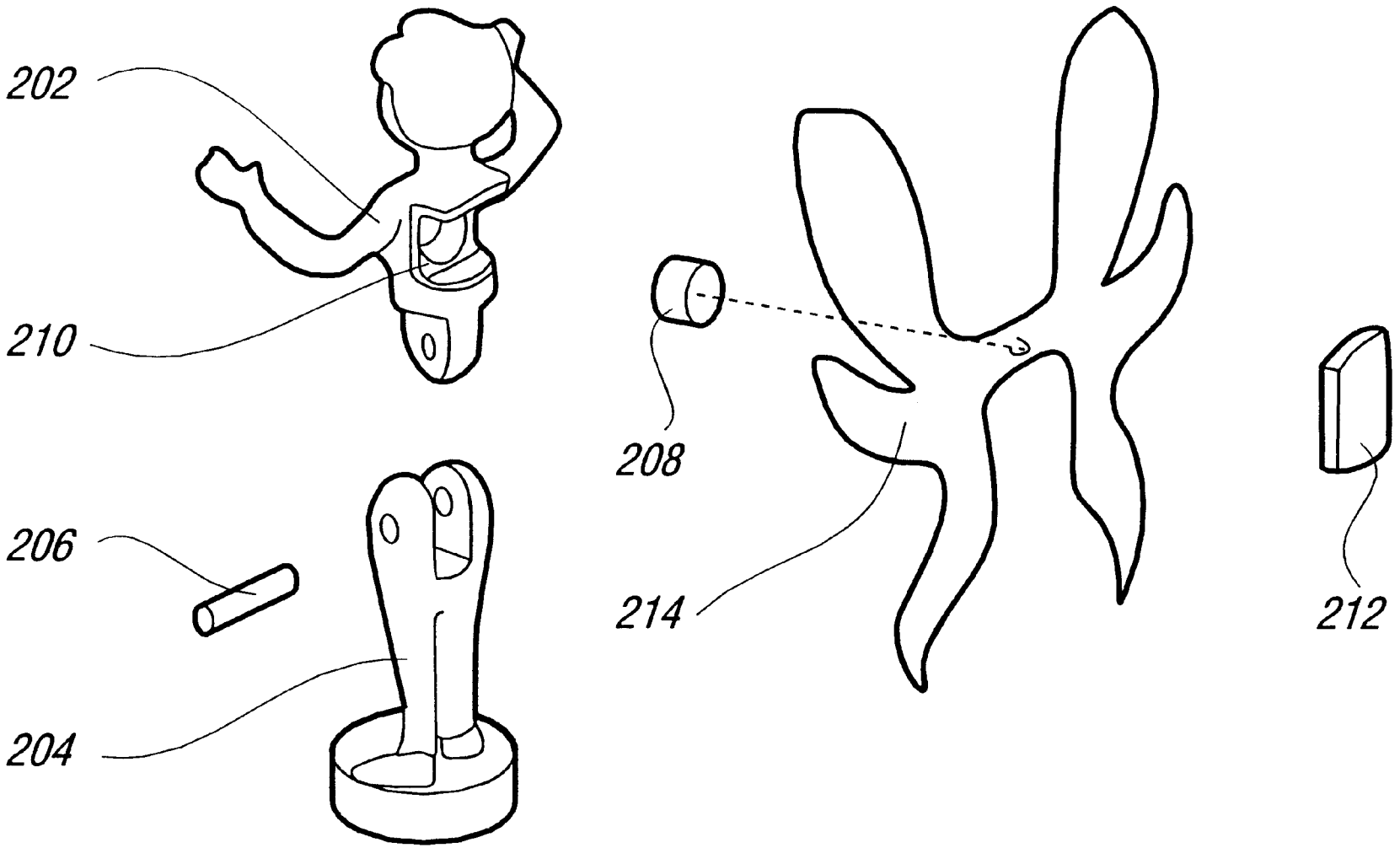
Figure 4:
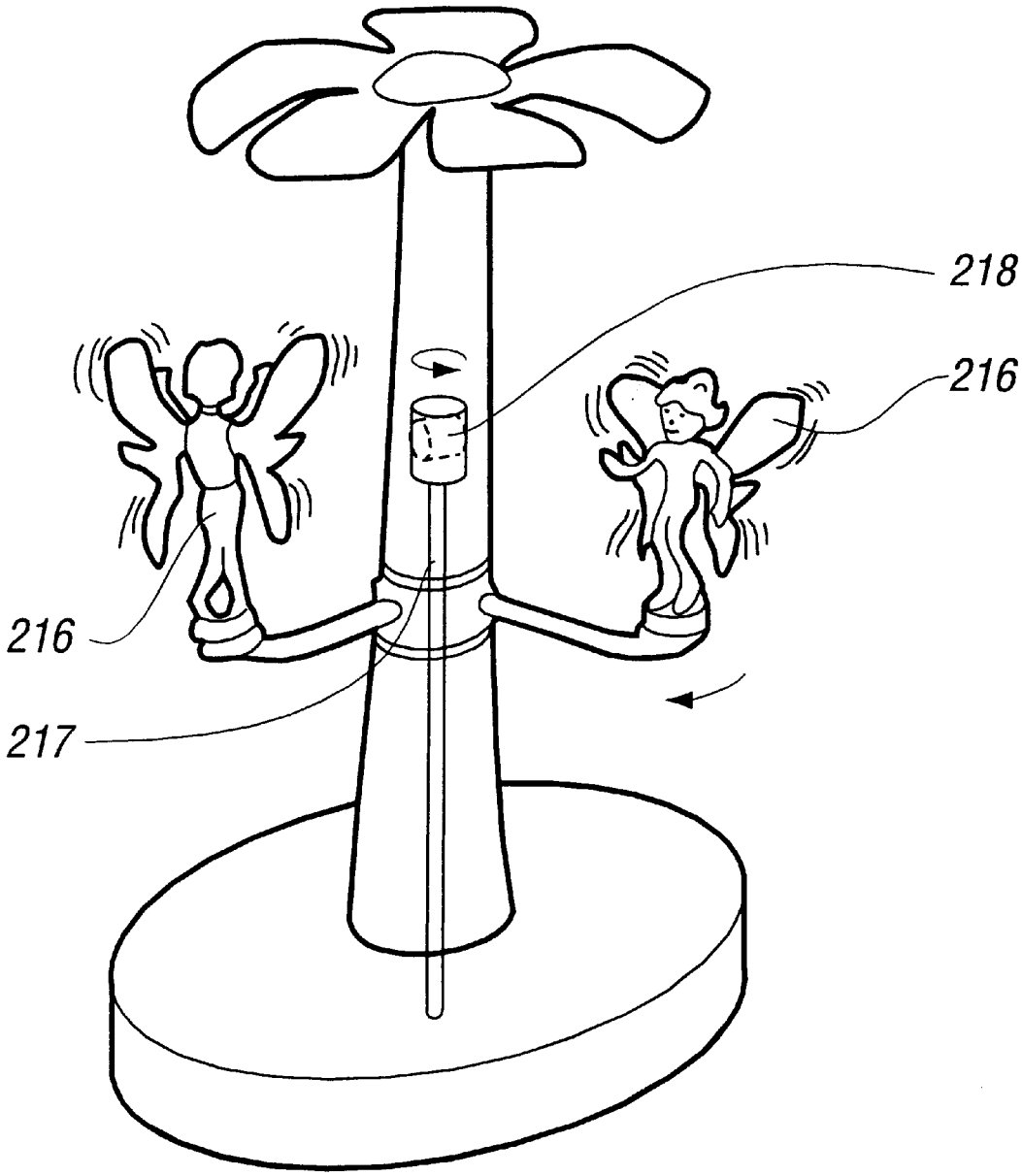
Figure 5:
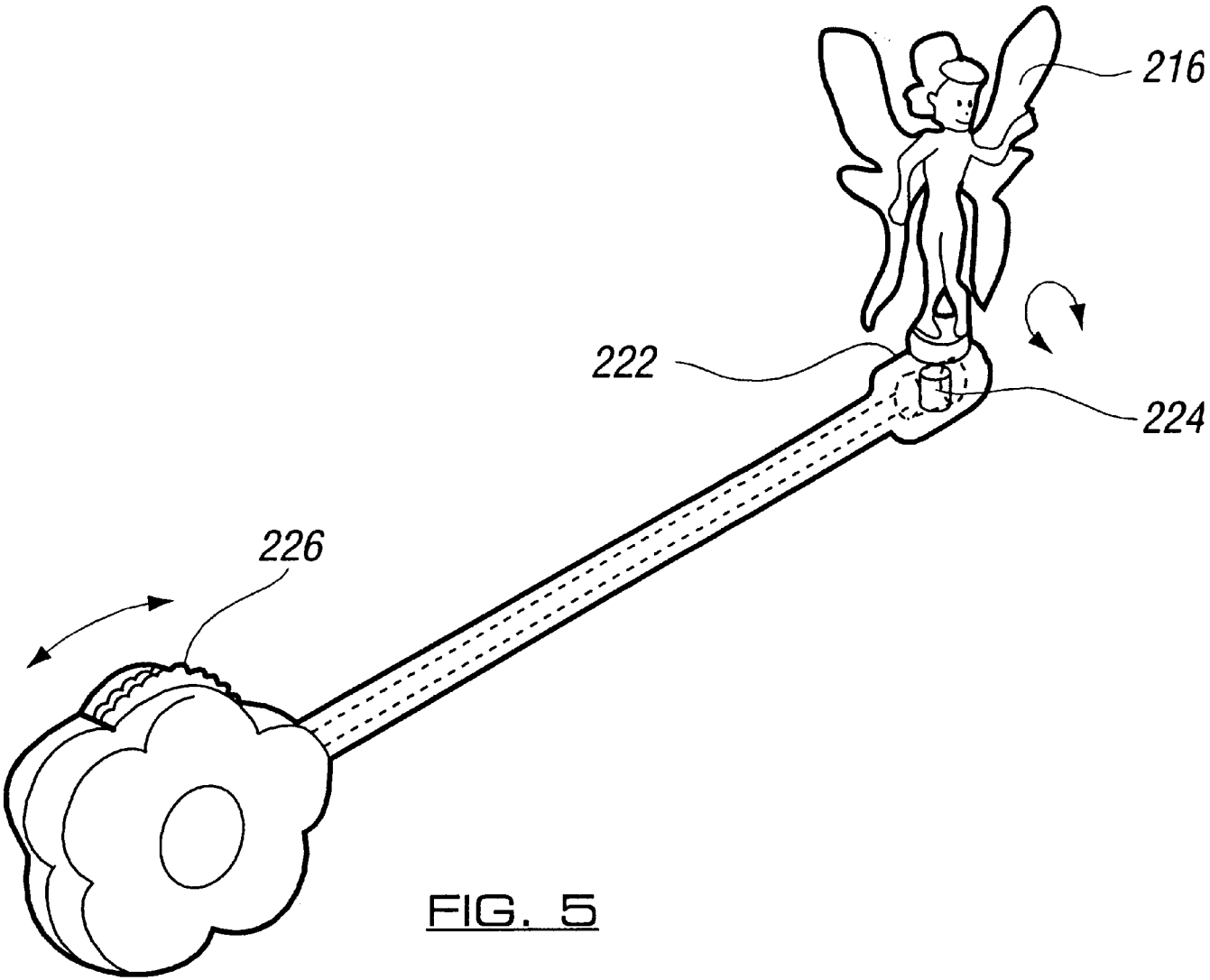

FIG. 2*a* illustrates a further embodiment of an article according to the present invention;

FIG. 2*b* is an exploded view of the article on the play base in FIG. 2*a*; and FIGS. 3–5 illustrate a character figure in accordance with one embodiment of the invention.

Referring firstly to FIGS. 1*a* and 1*b*, there is illustrated a toy comprising an article 2, a play base 4 and movement means 6.

The article 2 is in the form of a person in this embodiment and comprises a head portion 8, a body portion 10, arms 12 and 14 and legs 16. The article 2 is mounted on a stand 18 on the play base 4. It should however be noted that the article can be of any required form or thing to suit the toy requirement.

The article 2 is provided with rotatable joints 20 and 22. Rotatable joint 20 provides movement of the arm 12 relative to the body portion 10 and rotatable joint 22 provides movement of the body portion 10 relative to the legs 16 in a conventional manner.

Rotatable joint 20 is provided with a first magnet 24 located therein.

The movement means 6 is provided with a second magnet 26 and is hidden from view behind an object 28 on the play base 4. Rotation of the movement means 6 about a single axis as illustrated by arrows 27 results in rotation of the second magnet 26. The movement of the article is caused as a result of the interaction of the magnetic fields generated between the first and second magnets.

The movement means 6 is provided remote from the article 2 but adjacent thereto. Rotation of the second magnet 26 by actuation by the child results in rotation of the first magnet 24, and hence the rotatable joint 20, and gives rise to rotation of the arm 12. The arm 12 is provided with a drink 30 in a hand and rotation of the arm 12 simulates a drinking action of the article 2, as shown by arrow 32 in FIG. 1*a*.

Referring to FIGS. 2*a* and 2*b*, there is illustrated a further embodiment of the present invention and shows a toy comprising an article 102, a play base 104 and movement means 106.

The article 102 is in the form of a person and comprises a head portion 108, a neck portion 109, a body portion 110, arms 112 and 114 and legs 116. The article 102 is mounted on a stand 118 on the play base 104.

The article 102 is provided with rotatable joints 120 and 122. Rotatable joint 120 provides movement of the neck 109 and head 108 relative to the body 110 and rotatable joint 122 provides movement of the body portion 110 relative to the legs 116 in a conventional manners.

Rotatable joint 120 is in the form of a ball joint and has a first magnet 124 located therein.

The movement means 106 is provided with a second magnet 126. Actuation of the movement means 106 results in rotation of the second magnet 126. The second magnet 126 can be moved about a first axis as shown by arrow 128 and/or moved about a second axis as shown by arrow 130.

Movement of the second magnet 126 results in rotation of the first magnet 124 and hence the rotatable joint 120. This results in movement of the head in multiple directions, as shown by arrows 132 and 134 respectively in FIG. 2*a*, and gives rise to expressive head movement making the article look more realistic and lifelike. Typically the first magnet is mounted on a rotatable spindle such that its polar axis is at variance, such as 60 degrees, to the spindle axis so that when rotated in the vertical, the magnetic field, as well as rotating is caused to pitch up and down 30 degrees. This action imparts simultaneous movement in the two planes in the first magnet.

It will therefore be appreciated that in addition to the control magnet causing movement of the article the movement created is not necessarily to the same extent, direction and/or speed of the control magnet movement.

Movement of the movement means can result in movement of more than one part of the article. In addition, movement of the movement means could result in movement of one or more parts of a first article and this in turn results in movement of one or more parts of a further article. For example, a drinking action produced in a first article according to FIG. 1*a* could result in a drinking action in a second article. The transfer of movement between the first and second articles can be the result of the two articles being joined in some way or the result of the provision of a fourth magnet in the second article.

The play base can be provided with a control means having at least a third magnet which contacts the underside of the upper surface of the play base. The control means could impart movement of the article across the upper surface of the play base via interaction of the third magnet with a magnet provided in the stand/base 18 of the article, the magnet in the stand/base 18 contacting the upper surface of the play base. Movement of the one or more movable joints on the article(s) are actuated to move when the at least first magnet of the article is moved to within a predetermined distance from the at least second magnet of the movement means, and the interaction of the movement means magnet and the at least first magnet of the article induces motion.

FIGS. 3–5 illustrate one embodiment of the invention where in FIG. 3 there is shown the construction of a character comprising a body formed from parts 202 and 204 and pivotable about member 206. In the part 202 is located a magnet 208 which is loosely contained within the cavity 210 by cover 212 and in this case it should be noted that the magnet is not provided as part of a rotatable joint. In this case wings of fabric 214 are also provided and, in use, when a further, control, magnet of the movement means is rotated or oscillated, the magnet 208 is caused to move and, within the confines of the cavity 210, the movement acts on the wings to cause the same to appear to flap.

FIGS. 4 and 5 illustrate two embodiments of toy. In FIG. 4 several articles 216 are provided, each in accordance with FIG. 3 and in this case the control magnet is located with movement means 217. The rotation of the control magnet 218 causes the wings to flap. Drive means, not shown, can cause the articles 216 themselves to rotate so that they rotate at a different speed to the speed of movement of the wings, on each of the same.

FIG. 5 illustrates a further arrangement and in this case the article 216 is mounted on member 222 with a control magnet 224 located under the article. The movement means for the magnet are located at the opposing end of the member such that actuation of the movement means is created by linear movement by a persons hand on the thumbwheel 226 which in turn causes rotation of the control magnet 224 and hence cause the flapping action of the wings.

This is an example of the way in which the linear direction of movement of the actuation 226 of the thumbwheel can cause a direction of movement of the parts of the article, in this case the flapping action, which differs from the motion direction on the actuation.

In both these embodiments the movement effect on the wings is apparently independent of direct control by the person playing with the toy and without any apparent direct contact thus adding to the enjoyment of the toy to the child as the child is not required to move the movement means in the same direction or manner as the movement which is actually imparted to the article.

This is clearly different from the prior art where conventionally the direction of movement of the actuation of the movement means, causes a direct and identical response from the movable part of the article which can quickly become boring to a child. In contrast in the current invention movement in a first direction can be used to produce a different and surprising movement on the article part or parts.

What is claimed is:

1. A toy comprising:

at least one article with at least a first magnet provided therein and having one or more moveable parts to provide movement of one or more appendages of the article;

movement means for imparting movement of said moveable parts, said movement means comprising a second magnet positioned out of direct contact from the article; and wherein the at least first magnet and the second magnet are arranged with respect to one another whereby movement of a one of the at least a first magnet or the second magnet imparts movement of the other of the at least a first magnet or the second magnet, thereby providing animation of one or more appendages of the article.

2. A toy according to claim 1 wherein the movement means is moved in a linear and/or rotational path to impart linear and/or rotational motion to the one or more moveable joints.

3. A toy according to claim 1 wherein at least a first magnet or the second magnet or both are moved about multiple axes simultaneously.

4. A toy according to claim 1 wherein the at least first magnet of the article is located in a part of the article in the form of a moveable joint of the article and is moveable with said joint.

5. A toy according to claim 1 wherein the polarity of the magnets in the article and movement means are arranged such that there is a combination of north and south polarity acting between the magnets.

6. A toy according to claim 1 wherein the magnet in the article is positioned in a rotatable joint of the article with a magnetic polar axis perpendicular to the joint axis such that rotation of the said magnet by the movement means results in rotation of a part of the article.

7. A toy according to claim 6 wherein the magnet in the article is positioned in a rotatable joint such that rotation of the same via the movement means results in rotation of a plurality of parts of the article.

8. A toy according to claim 6 wherein the article is a scale model of a human figure and a rotatable joint is provided at the neck and/or between the arms such that rotation of the magnet in one or other or both rotatable joint, via movement of the movement means, results in rotation of the head and/or arms.

9. A toy according to claim 6 wherein the rotatable joint of the article is a ball joint and the first magnet is located in the same.

10. A toy according to claim 6 wherein the rotatable joint of the article is a cylindrical joint and the first magnet is located in the same.

11. A toy comprising a play base; at least one article which is moveable about an upper surface of said play base, said at least one article having at least a first magnet located in one or more moveable joints; and a second magnet positioned remotely and out of contact with the article and arranged to impart movement of said one or more moveable joints thereby providing animation of the at least one article, by movement of the article and/or the second magnet with respect to each other.

12. The toy according to claim 11 comprising a control means for providing movement of the article across the play base in a selected path defined by movement of the control means via interaction with a magnet provided in the base of the at least one article.

13. The toy according to claim 12 wherein as the article is moved across the surface of the play base using the control means, one or more moveable joints on the article are actuated to move when the article comes into proximity with the second magnet located on the play base.

14. The toy according to claim 13 wherein a number of magnets are provided in spaced locations on the play base.

15. The toy according to claim 1 wherein the movement of one or more parts of the article results in movement of one or more further articles or parts thereof.

16. A toy, said toy comprising at least one article with at least a first magnet positioned therein and having one or more moveable parts; and movement means with at least a second magnet rotatably positioned therein, to provide movement of one or more parts of said article when the said first and second magnets magnetically influence each other and wherein actuation of the movement means in a first direction results in movement of the part or parts of the article in a direction other than the said first direction.

17. A toy according to claim 16 wherein actuation in a linear direction causes rotational movement of the part of the article.

18. A toy comprising:

an article having a body including a cavity therein and at least a first magnet rotatably mounted in the cavity, said at least a first magnet attached to a first appendage extending from the body, movement means for imparting movement to said at least a first magnet, said movement means positioned out of direct contact from the article.

19. The toy of claim 18 wherein the first appendage comprises an arm.

20. The toy of claim 18 wherein the first appendage comprises a neck or head.

21. The toy of claim 18 wherein the movement means comprises a second magnet.

22. The toy of claim 21 wherein movement of the second magnet induces the appendage to move simultaneously about two axis positioned 90° from each other.

23. The toy of claim 18 wherein the first appendage comprises wings.

24. The toy of claim 23 wherein the second magnet induces the first appendage to oscillate.

25. The toy of claim 18 wherein the first appendage is attached to the body with a moveable joint.

26. The toy of claim 25 wherein the at least first magnet is positioned in the moveable joint.

27. The toy of claim 25 wherein the joint comprises a ball joint.

28. The toy of claim 25 wherein movement of the second magnet induces the appendage to move simultaneously in two planes positioned 90° from each other.

29. The toy of claim 25 wherein the joint comprises a cylindrical joint.

30. The toy of claim 29 wherein cylindrical joint defines a spindle axis and the at least a first magnet is positioned to have a polar axis at a variance with the spindle axis.

31. The toy of claim 30 wherein the at least a first magnet is positioned such that its polar axis is at a 60° angle to the spindle axis.

32. The toy of claim 31 wherein the first appendage comprises a head.

33. The toy of claim 18 wherein the article comprises a second moveable appendage and wherein movement of the second magnet induces movement of the first appendage and the second appendage.

34. The toy of claim 33 wherein the first appendage comprises an arm and the second appendage comprises a neck, a head or both.

35. The toy of claim 18 wherein linear movement of the movement means imparts rotational movement to the at least a first magnet.

36. The toy of claim 18 wherein rotational movement of the movement means imparts rotational movement to the at least a first magnet.

37. The toy of claim 18 comprises a play base and wherein the article is moveable about the play base.

38. The toy of claim 37 wherein movement of the article with respect to the movement means induces movement of the first appendage.

39. The toy of claim 37 comprising control means for inducing movement of the article about the play base, said control means comprising a third magnet and the article comprises a base having a fourth magnet.

40. The toy of claim 37 comprising a plurality of movement means located at different positions on the play base.

41. The toy of claim 37 comprising a plurality of articles each article including a moveable appendage.

42. The toy of claim 41 wherein a single movement means induces movement of the moveable appendages in each of the plurality of articles.

43. The toy of claim 42 wherein the moveable appendages move simultaneously.

44. A toy comprising:

an article having a body including a cavity therein and a first magnet rotatably mounted in the cavity, said first magnet attached to a first appendage extending from the body, a member having a distal end and a second magnet rotatably mounted on said distal end, and positioned to impart motion of the first magnet via the interaction of the magnetic fields of the first magnet and the second magnet.

45. The toy of claim 44 wherein the distal end of the member is positioned out of direct contact from the article.

46. The toy of claim 44 wherein the first appendage comprises an arm.

47. The toy of claim 44 wherein the first appendage comprises a neck.

48. The toy of claim 44 wherein the first appendage comprises a head.

49. The toy of claim 48 wherein movement of the second magnet induces the appendage to move simultaneously about two axis positioned 90° from each other.

50. The toy of claim 44 wherein the first appendage comprises wings.

51. The toy of claim 50 wherein the second magnet induces the first appendage to oscillate.

52. The toy of claim 44 wherein movement of the second magnet induces the appendage to move simultaneously in two planes positioned 90° from each other.

53. The toy of claim 44 comprising a plurality of articles each article including a moveable appendage.

54. The toy of claim 53 wherein movement of the second magnet induces movement of the moveable appendages in each of the plurality of articles.

55. The toy of claim 54 wherein the moveable appendages move simultaneously.

* * * * *